United States Patent [19]

Goel

[11] 4,184,431

[45] Jan. 22, 1980

[54] TRACK LAYING TRAIN

[75] Inventor: Pierre Goel, Lausanne, Switzerland

[73] Assignee: Canron, Inc., Toronto, Canada

[21] Appl. No.: 819,390

[22] Filed: Jul. 27, 1977

[30] Foreign Application Priority Data

Jul. 27, 1976 [CH] Switzerland ..... 9560/76

[51] Int. Cl.[2] ..... E01B 29/05

[52] U.S. Cl. ..... 104/2; 104/6; 105/215 C

[58] Field of Search ..... 104/2, 3, 4, 5, 6, 7, 104/9; 105/215 C

[56] References Cited

U.S. PATENT DOCUMENTS

| | | | |
|---|---|---|---|
| 3,654,868 | 4/1972 | Plasser et al. | 104/5 |
| 3,691,957 | 9/1972 | Plasser et al. | 104/5 |
| 3,699,894 | 10/1972 | Plasser et al. | 104/5 |
| 3,807,310 | 4/1974 | Plasser et al. | 104/2 |
| 4,046,077 | 9/1977 | Theurer et al. | 104/2 |

FOREIGN PATENT DOCUMENTS

| | | | |
|---|---|---|---|
| 2313055 | 9/1974 | Fed. Rep. of Germany | 104/3 |
| 2410718 | 9/1975 | Fed. Rep. of Germany | 104/2 |
| 1303502 | 12/1962 | France | 104/3 |

*Primary Examiner*—Joseph F. Peters, Jr.

*Assistant Examiner*—Ross Weaver

*Attorney, Agent, or Firm*—Wenderoth, Lind & Ponack

[57] ABSTRACT

A railway track renewal or construction car for use in a track renewal or construction train, which car is in the form of a straight beam resting on its ends on two rail engaging bogies, the front of which is adapted to roll on the old track to be renewed and the rear of which runs on the track which just has been renewed. Between the bogies, there is provided a device for removing the rails of the old track, means for discarding the old ties, a means for regulating the ballast, a means for laying new ties and a means for closing the new rails previously laid on either side of the track. In order to permit such a car to operate on a cleared right-of-way where no previous track exists, the car is provided with a telescopic undercarriage which can be lowered onto the ballast of the right of way replacing the front bogie as a front support for the car. The undercarriage is provided with a suitable rolling device such as an endless track. The undercarriage may be wider than the track gauge or narrower than the track gauge, and where wider than the track gauge, a runner arrangement may be provided to allow the car to proceed in reverse back from a construction site with the undercarriage supported clear of the rails of the track.

5 Claims, 4 Drawing Figures

F

TRACK LAYING TRAIN

BACKGROUND OF THE INVENTION

The present invention relates to trains for renewal and construction of railroad tracks.

Railroad track renewal trains of this type are disclosed in French Pat. No. 1,303,502 and Swiss Pat. No. 511,332.

The trains so described, are adapted, after the deposit of new rails outside of old track, to lift and spread the old rails, to remove the old ties one by one, to regulate the surface of the ballast bed, to lay new ties one by one, to draw in the new rails and to position them on the new ties at the new gauge while continuously travelling forward on the old track.

To this effect, these renewal trains comprise a formation of supply cars attached to a so-called substitute or replacement car in the form of a straight beam resting by its ends on two rolling means, such as bogies, one of which is adapted to roll on the old track to be renewed and the other on the new track which has been renewed and comprising, mounted in tandem between the said rolling means, a device for removing the rails of the old track, a means for discarding the old ties, a means for regulating the ballast, a means for laying new ties and a means for closing new rails previously laid on either side of the track.

These trains are satisfactory for the renewal of railroad tracks, i.e. for the replacement of old material on an old track by new material, but these trains cannot be used for the construction of a railroad track of the kind where merely a surface of ballast is provided, whereon a track substitute or replacement car cannot be supported.

This is the reason why, for the construction of new track, reliance has generally been placed on systems consisting of transporting gantries for preassembled panels, rolling on auxiliary rails resting on the surface of the new track or on construction trains consisting of preassembled track panels attached to a laying car consisting of a beam projecting forward allowing the laying of preassembled panels on which the train advances afterward as the panels are laid.

An object of this invention is to allow, either the construction of, or the renewal of, railroad tracks using a single train as described above by means of which the new ties are laid one by one in a continuous forward travel.

SUMMARY OF THE INVENTION

To this effect, the train for renewal and construction of railroad tracks described in this invention, is characterized in that the replacement car comprises, between the rolling support on the old track and the system to remove the old ties, a steerable supplementary retractable off-track under-carriage, fitted with a rolling mechanism suitable to travel on a ballast bed, as for example low-pressure tired wheels or an endless track, and in that at least the means to remove the old ties comprises an individual system for its retraction, independent from the means to lay the new ties.

Preferably, the systems to remove or lay the ties will be located in the immediate proximity of this retractable supplementary support to minimize the deviation between their location and axis of the railroad track in the curves.

DESCRIPTION OF THE DRAWINGS

The following is a description, by way of example, of one embodiment of the present invention, reference being had to the accompanying drawings, in which.

DESCRIPTION OF THE PREFERRED EMBODIMENT

Figures 1, 2, 3, 4:
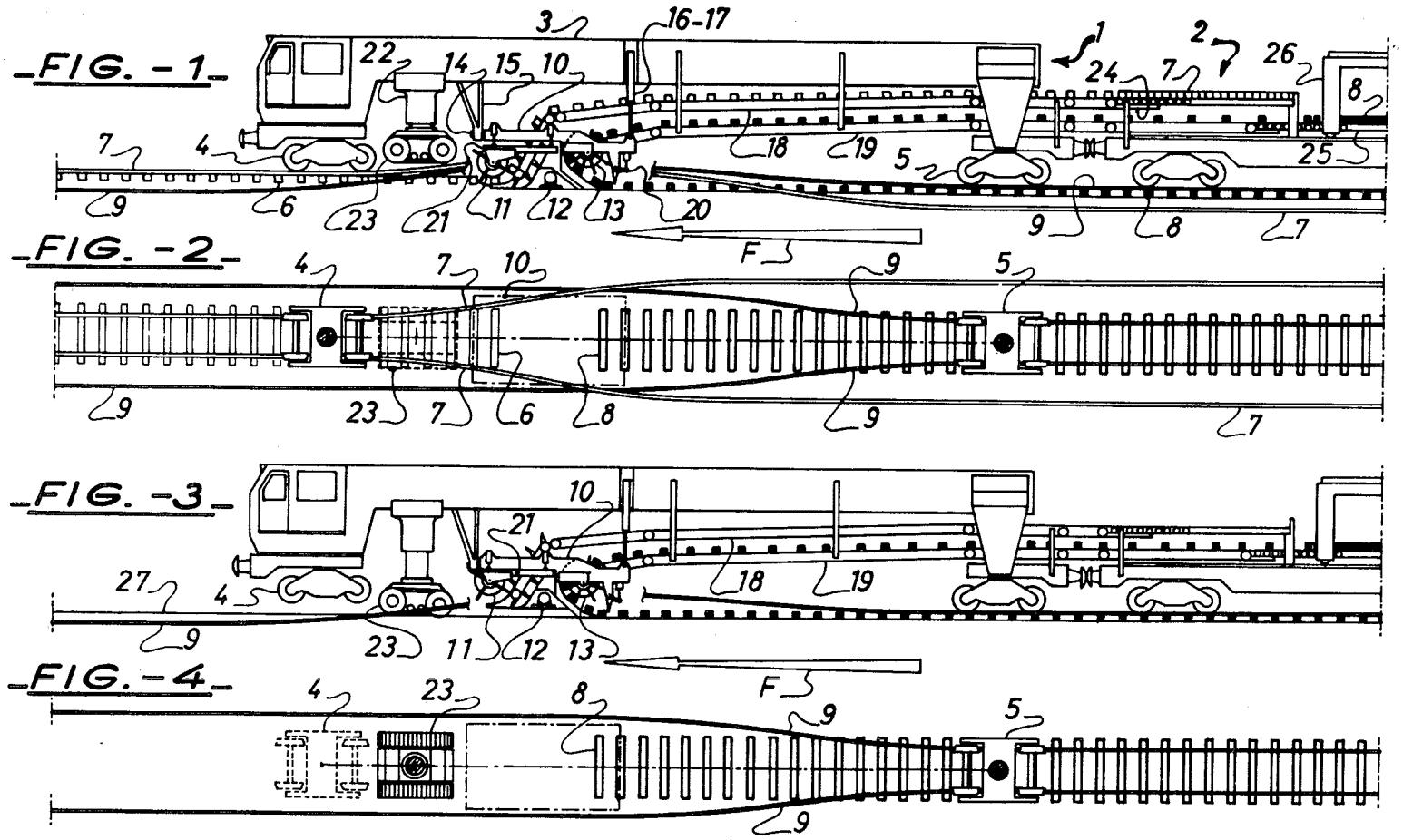
FIGS. 1 and 2 are respectively a partial elevation and a partial plan view of a system suitable for the renewal of a railroad track.
FIGS. 3 and 4 are respectively a partial elevation and a partial plan view of a system suitable for the construction of a railroad track.

In the drawings, the illustration of the train is limited to the substitution or replacement, car 1 and a part of the first car 2 of a number of material supply cars.

The rigid frame 3 of the replacement car 1 is supported at its ends on two rolling supports, a front bogie 4 and a rear bogie 5, the working direction of the train being shown by the arrows F.

In FIG. 1 the front bogie 4 rolls on the existing track to be renewed, consisting of the ties 6 and rails 7 whilst the rear bogie 5 rolls on the new track consisting of the newly laid ties 8 and newly laid rails 9.

A tie removing device 11 for the old ties 6, a ballast regulating device 12 and a tie laying device 13 for the new ties 8 (all known per se) are mounted on a supporting frame 10, suspended on frame 3.

The supporting frame 10 is suspended from the rigid frame 3 by a forward articulation joint 14 mounted on a supporting bracket 15 and by two rear lateral cylinders 16 and 17 disposed on either side of the frame. The parallel or differential action of the cylinders 16, 17 permits the adjustment of transversal incline of the frame 10, in order to place it on the desired working level or move it out of action.

The tie removal device 11 and the tie laying device 13 are illustrated as standard wheel type devices and are operatively connected to the first supply car 2 by means of inclined conveyors 18 and 19.

A tie distributing means 20 for the new ties 8, is driven, in a known manner, in relation to the distance travelled by the train, and is shown located at the inclined end of the tie laying device.

The tie removal device 11 and the ballast-regulating device 12 are mounted on an auxiliary frame 21 which is connected by means of cylinders to the supporting frame 10, in order to permit their being removed out of action, independent of the tie laying device 13.

Between the front bogie 4 and the tie-removing device 11, a supplementary retractable undercarriage 22 is mounted fixedly on the rigid frame 3 of the replacement car. The supplementary undercarriage includes a carriage 23 fitted with a suitable ground engaging rolling means, (shown here as an endless tracked vehicle) adapted to roll on the ballast bed and is mounted so as to be angularly adjustable relative to the longitudinal axis of the track so that it can be steered. The lifting and lowering of the carriage 23 is carried out by any suitable means, such as telescopic hydraulic cylinders; a gear train arrangement, or a pulley and tackle system (not shown), and the control of the lifting and lowering action, along with the steering control, is preferably from the control cabin of the train by any known means, such as hydraulic, mechanical, or electric transmissions.

The replacement car 1 is further equipped with a device to spread the old rails 7 and to close the new rails. This device is not shown, being known per se, and having been described, for example, in aforementioned Swiss Pat. No. 511,332. The device so described comprises rigid frames attached to the main frame (like 3) of a replacement car and is provided with guiding rollers, the function of which is to make them follow a curved route as shown here in FIGS. 1 and 2.

In FIG. 2 only the bogies 4 and 5 of the replacement car have been shown to outline this rail movement. It will be seen that the old rails 7 are spread and raised immediately after passage of the front bogie 4 so as to allow the renewal of the old ties 6, the regulation of the ballast and the laying of the new ties 8 at the location shown in dotted lines of the supporting frame 10. In this track renewal configuration, the carriage 23 of supplementary undercarriage 22 is retracted clear of the track to its high position, see FIG. 1 and the dotted lines in FIG. 2.

As is also seen in FIG. 2, the new rails 9, which have been previously laid on the track shoulder are first raised, threaded under the old rails which have been spread, and then closed in to the standard gauge width level with the new ties 8 on which they are deposited on their defined position on the tie plates just ahead of the rear bogie 5 of the replacement car 1 to permit this car and the supply cars to roll on the new track. This procedure is in accordance with standard practice.

On the first supply car 2 are shown an accumulation 24 of old ties 7, an accumulation 25 of new ties 8 and a gantry crane 26 used to load or unload these ties and to transport the said ties along the train formation to their stocking positions.

In contradistinction to this old railroad track renewal configuration shown in FIGS. 1 and 2, FIGS. 3 and 4 shown an appropriate configuration for the construction of a new railroad track.

In this case, the undercarriage 22 is extended so that the carriage 23 is lowered, below the support level of the front axle 4, and the endless track rests on the previously levelled ballast surface 27 of the track to be constructed so as to support the front end of the replacement car 1, as best seen in FIG. 3. The auxiliary frame 21, supporting the tie removing device 11 and the regulating device 12 are taken out of action by raising them with the aid of their cylinders suspended on the supporting frame 10 and disconnecting the controls of these devices as well as that of the old tie conveyor 18. Only the new tie laying device 13 and its associated conveyor 19 are activated.

As seen in FIG. 4, in this configuration for construction of a new railroad track, the replacement car 1 rests in the front on its carriage 23 on the ballast surface and the bogie 4 shown in dotted line is in a raised position and the car 1, as before, rests at the rear thereof, on the rear bogie 5 on the newly laid track, that is, after the closure of the new rails 9 which were previously laid on each side of the future track.

To facilitate the train return from a construction site, a skate-like runner support, or skid arrangement adapted to be erected on the carriage 23 when the carriage 23 is, as shown in the drawings, wider than the gauge of the track, is advantageously provided. This runner support (not shown) will be narrower than the gauge of the new track in order to allow the closing of the rails. It is placed on the ties under the carriage 23 and under the front bogie 4 to allow for support of the said front bogie and to raise the carriage 23 clear of the rails so as to permit the train to back-up.

It is unnecessary to provide this runner support arrangement in the configuration where the carriage 23 is narrower than the gauge of the track, since this narrower carriage allows for the reverse rolling of the renewal car 1 on the ties last laid, until the renewal car 1 reaches the new rails laid at standard gauge and able to support the renewal car 1. At this point the supplementary undercarriage 22 is retracted and the front bogie 4 engages the newly laid rails.

It will of course be understood that variations of the construction described herein can be made without departing from the general concept of the invention, for example, carriage 23 could be equipped with low pressure tire wheels instead of the endless track and the telescopic column of the undercarriage 22 could be replaced by any suitable system permitting vertical movement, for example, a counter-weighted link system. Additionally, the tie removing or tie laying devices could be of the elevator type with a vertical distribution, rather than the wheel type with the inclined plane conveyor as described.

What I claim as my invention:

1. A railroad track construction and replacement car for railroad track construction train, said car having a longitudinally extending main frame; a rolling support means for engaging railway track at either end of said frame; and, between said rolling support means, means for spreading the old rails apart; means for closing new rails previously laid on the ballast; a support frame, means connected to said support frame for levelling railway ballast; means connected to said support frame for laying new ties one after the other; an auxiliary frame connected to said support frame, means for removing old ties one after the other connected to said auxiliary frame; a steerable supplementary retractable off-track undercarriage between the leading rolling support means and and the old tie removing means; and means for retracting the auxiliary frame out of operative position independently of the new tie laying means.

2. A car as claimed in claim 1 in which the old tie removing means and the new tie laying means are located in close proximity to said undercarriage.

3. Apparatus as claimed in claim 1 in which said undercarriage terminates in a carriage carrying ballast engaging rolling means.

4. Apparatus as claimed in claim 2 in which said ballast engaging rolling means is an endless track.

5. A device as claimed in claim 3 in which the width of said carriage is larger than the gauge of the rails of the railway track; and in which a supplementary retractable runner support is mounted on said undercarriage which runner support has a width less than the gauge of the rails of the railway track.

* * * * *